US006330339B1

(12) United States Patent
Ishige et al.

(10) Patent No.: US 6,330,339 B1
(45) **Date of Patent: *Dec. 11, 2001**

(54) HEARING AID

(75) Inventors: Ryuuichi Ishige; Reishi Kondo, both of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/773,954

(22) Filed: Dec. 26, 1996

(30) Foreign Application Priority Data

Dec. 27, 1995 (JP) ..... 7-340960

(51) Int. Cl.[7] ..... H04R 25/00

(52) U.S. Cl. ..... 381/312; 387/67; 387/320; 387/321

(58) Field of Search ..... 381/23.1, 60, 68.2, 381/68.4, 68, 68.3, 67, 312, 317, 320, 321, 314; 340/506, 531, 522, 689, 573.1, 573.7

(56) References Cited

U.S. PATENT DOCUMENTS 3,132,208 * 5/1964 Dymski et al. ..... 381/67
4,318,245 * 3/1982 Stowell et al. ..... 46/232
4,425,481 * 1/1984 Mansgold et al. ..... 381/68.2
4,534,058 * 8/1985 Hower ..... 381/67
5,111,506 * 5/1992 Charpentier et al. ..... 381/68.4
5,467,775 * 11/1995 Callahan et al. ..... 381/67
5,604,811 * 2/1997 McIntyre et al. ..... 381/67

FOREIGN PATENT DOCUMENTS 58-57899 4/1983 (JP) .
1-269400 10/1989 (JP) .
2-62896 5/1990 (JP) .
4-242400 8/1992 (JP) .
5-344595 12/1993 (JP) .
6-105399 4/1994 (JP) .
8-163700 6/1996 (JP) .

* cited by examiner

*Primary Examiner*—Huyen Le
(74) *Attorney, Agent, or Firm*—Foley & Lardner

(57) ABSTRACT

Outputs of a pulse sensor, a brain wave sensor, a conductivity sensor and an acceleration sensor are input to respectively corresponding condition detecting means, and the condition of the wearer (biological information, motion) is detected by the condition detecting means. The condition determining means determines the operation mode of the hearing aid from the condition of the wearer according to predetermined algorithm. Operation mode control portion drives an earphone based on the operation mode. By this, the characteristics of the hearing aid can be varied adapting to the wearer's condition.

19 Claims, 6 Drawing Sheets

HEARING AID

BACKGROUND OF THE INVENTION

1. Field of the Invention

The present invention relates to a hearing aid with variable operation modes.

2. Description of the Related Art

In the recent years, digital signal processing is applied in a hearing aid, which enables more complicated signal processing in comparison with an analog hearing aid. However, on the other hand, for digital processing, parts consuming large power, such as DSP (Digital Signal Processor) and CPU (Central Processing Unit) are used in the hearing aid. Therefore, it shortens the duration of continuous operation of the hearing aid.

Therefore, in the hearing aid employing digital signal processing (hereinafter referred to as "digital hearing aid"), there has been proposed a method to reduce power consumption by controlling circuit blocks to be operated depending upon an input voice signal.

FIG. 1 is a circuit diagram showing the conventional digital hearing aid. As shown in FIG. 1, the digital hearing aid is constructed with a microphone 1 which converts a voice signal into an electric signal, an input amplifier 2 amplifying the electric signal, a voice level judgement circuit 3 judging magnitude of amplified signal, a signal processing circuit 4 processing the amplified signal, a changeover switch 5 for selecting the amplified signal of the input amplifier 2 and the processing signal of the signal processing circuit 4, an output amplifier 6 outputting a selection signal, an earphone 7 converting the output signal into the voice signal, a power source 8 driving all of the foregoing circuits, a switch 9*a* for shutting off power supply for the signal processing circuit 4, and a switch 9*b* for shutting off the power supply for the output amplifier 6.

When the switches 9*a* and 9*b* supply power to the signal processing circuit 4 and the output amplifier 6, the hearing aid amplifies the input signal of the microphone 1 by the input amplifier 2. Then, after signal processing by the signal processing circuit 4, the earphone 7 is driven by the output of the output amplifier 6. The input voice signal level is judged by the voice level judgement circuit 3 to control power supply to the signal processing circuit 4 and the output amplifier 6. Namely, while no voice condition, power supply for both of the signal processing circuit 4 and the output amplifier 6 is shut off. In an ordinary sound field level in normal life, power supply only for the signal processing circuit 4 is shut off. The changeover switch 5 selects the output signal of the input amplifier 2 to supply to the output amplifier 6 so that the earphone 7 is driven by the output signal of the output amplifier 6.

On the other hand, Japanese Unexamined Patent Publication (Kokai) No. Heisei 6-105399 discloses a hearing aid, in which standard patterns representing typical input sounds are preliminarily registered, mutually different hearing compensation methods are provided with respect to respective patterns for selecting hearing compensation methods depending upon the input sound.

However, as set forth above, while the digital hearing aid is advantageous for permitting complicated signal processing, it encounters a problem of short duration in continuous operation for employing parts consuming large amount of power, such as DSP, CPU or so forth.

Japanese Unexamined Patent Publication No. Heisei 5-344595 proposed as a solution for the problem set forth above, merely discloses a hearing aid which varies operation modes depending upon an input voice signal. On the other hand, Japanese Unexamined Patent Publication No. Heisei 6-105399 discloses a hearing aid which merely varies hearing compensation method only depending upon the input voice signal.

Namely, these hearing aids performs switching of the operation modes or hearing compensation methods ignoring condition upon wearing condition or desire of the wearer, and thus cannot vary characteristics adapting to the condition of the wearer. For example, it is possible to be caused a condition where the operation mode or hearing compensation method is not varied for environmental sound being held unchanged, despite that the wearer is in sleeping.

SUMMARY OF THE INVENTION

It is an object of the present invention to provide a hearing aid which can vary adapting a characteristics to a wearer's condition.

According to one aspect of the invention, a hearing aid with variable operation mode, comprises: one or more condition detecting means for detecting a biological signal or motion representative of condition of a wearer; condition determining means for determining an operation mode on the basis of result of detection of said condition detecting means; and operation mode control portion driving an earphone according to an operation mode output from said condition determining means.

On the other hand, according to another aspect of the present invention, a hearing aid comprises: timing means for outputting a time; condition determining means for determining an operation mode with predicting condition of a wearer on the basis of said time; and operation mode control portion for driving an earphone according to an operation mode output from said condition determining means.

The hearing aid may further comprise a power control means for controlling at least one selected from a group consisting of a circuit block to be operated, voltage, and clock frequency depending upon a wearer's condition and time to control power consumption.

Furthermore, according to the present invention, the hearing aid may further comprise a hearing aid processing portion, the operation of the said hearing aid processing portion and hearing aid processing parameter which determines hearing aid characteristics of the said hearing aid being varied depending upon said the condition of the wearer and time.

In the present invention, depending upon condition of the wearer (in sleep, in tension, in motion or so forth), control of operation mode, such as modification of hearing compensation processing method, such as simplification of the hearing compensation process, modification of circuit block to be operated, is performed to adapt the operation of the hearing aid with the condition of the wearer.

On the other hand, in the present invention, since operation mode can be according to the time, operation adapted to the time of the day is possible. Namely, operation mode is varied by setting time of the wearer.

Furthermore, in the present invention, since a power control means is provided in the hearing aid, power saving can be realized by varying the power consumption depending upon the condition of the wearer and the set time.

Also, in the present invention, operation of the hearing aid processing portion and hearing aid processing parameter which process hearing compensation depending upon condition after wearing and set time, are controlled to permit hearing aid process to adapt to the wearer's condition and set time.

According to the present invention, the operation mode can be controlled by judging physical and mental conditions from the condition of the wearer. For example, when the wearer is sleeping, gain is made smaller in comparison with the normal mode. In the alternative, it is possible to set the operation mode in low speed operation mode with simplified hearing aid process. When the wearer is in tension, a mode wherein gain is elevated to remove noise, can be selected.

On the other hand, by monitoring the time by the timer, it is possible to vary the operation mode of the hearing aid depending upon set time.

Furthermore, power saving can be realized by varying one or more of power consumption, operation speed, power source voltage, and component to supply power. More specifically, power saving can be realized by stopping of power supply for the portion which can stop operation, lowering power source voltage to establish sleep mode, lowering of operation speed by lowering the clock speed and so forth. It should be noted that varying of the operation mode is performed exclusively depending upon the condition of the wearer and/or timing set by the wearer.

In addition, by varying the operation of the hearing aid processing portion, hearing aid parameter and so forth, hearing aid characteristics of the hearing aid can be varied adapting to the wearer's condition and set time.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
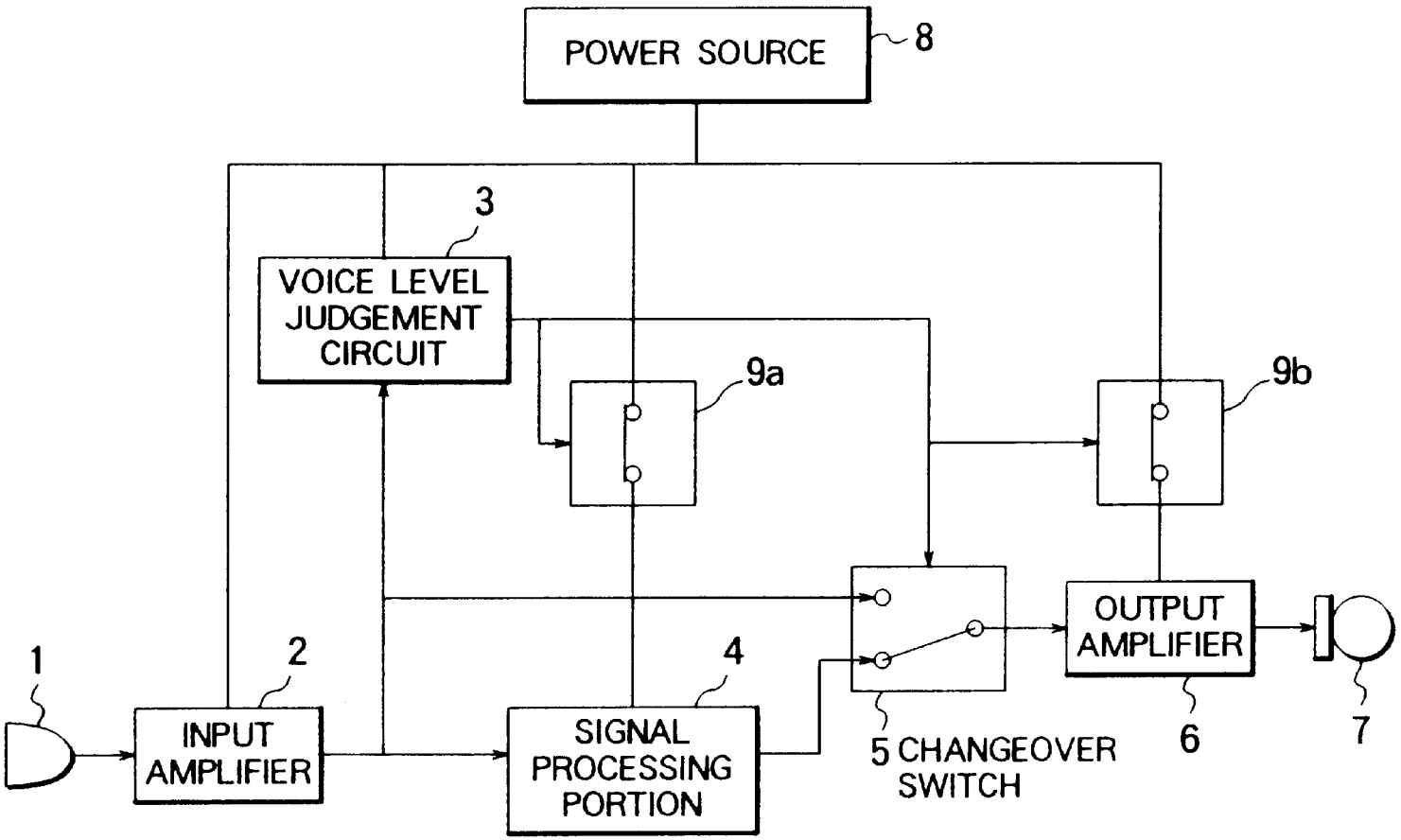
FIG. 1 (PRIOR ART)
FIG. 1 is a block diagram showing the conventional hearing aid.
Figure 2:
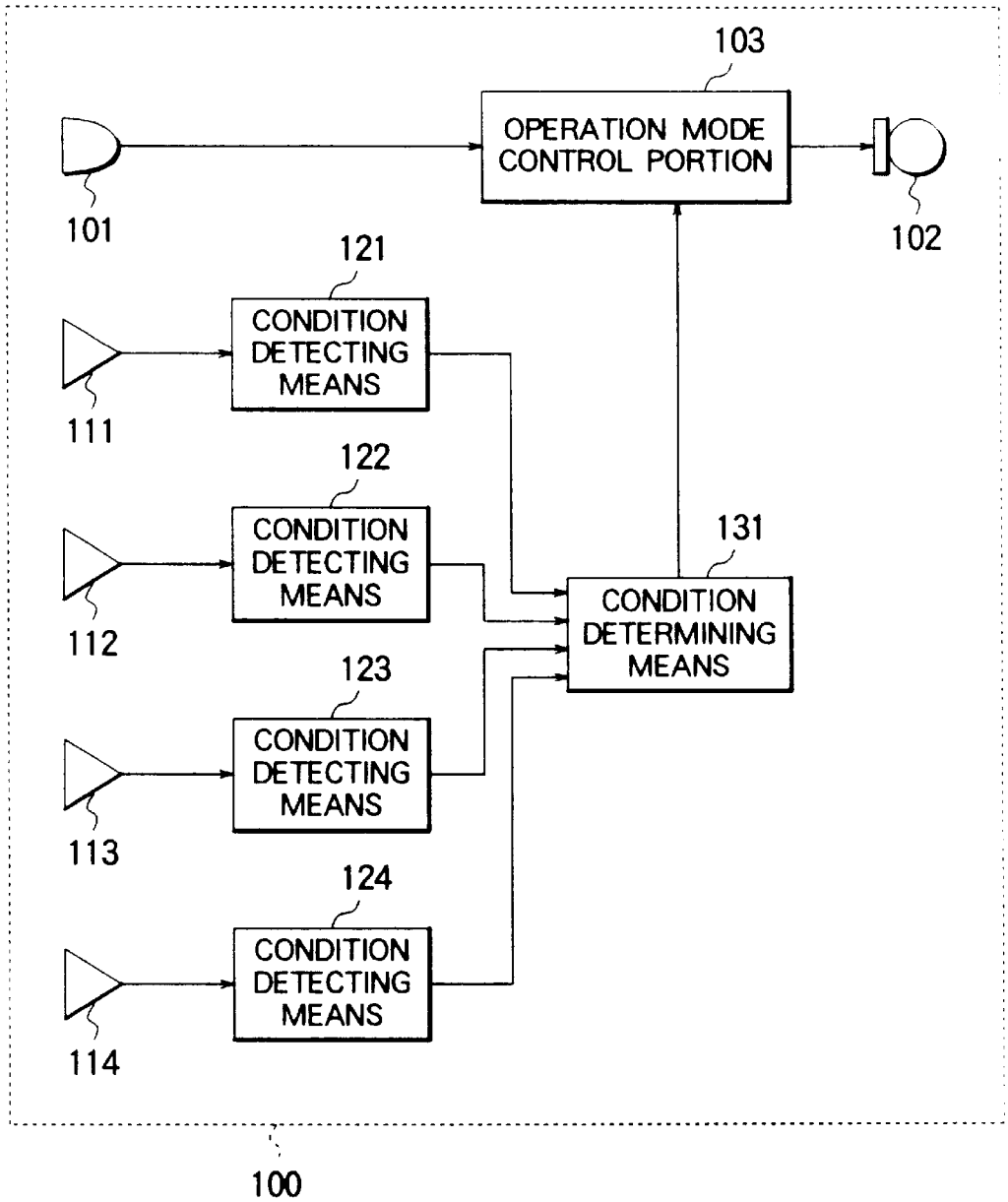
FIG. 2 is a block diagram showing a first embodiment of a hearing aid according to the present invention.

FIG. 2 is a block diagram showing the first embodiment of a hearing aid according to the present invention. A hearing aid 100 of the shown embodiment has a microphone 101 converting a voice signal into an electric signal, an earphone 102 converting an output signal into a voice signal, an operation mode control portion 103, a throb sensor or pulse sensor 111, a brain wave sensor 112, a conductivity sensor 113, an acceleration sensor 114, condition detecting means 121, 122, 123 and 124, and condition determining means 131.

In such hearing aid 100, outputs of the pulse sensor 111, the brain wave sensor 112, the conductivity sensor 113 and the acceleration sensor 114 are input to the corresponding condition detecting means 121. 122, 123 and 124. Respective condition detecting means 121, 122, 123 and 124 detect condition (biological information, motion) of the wearer and feed the results of detection to the condition determining means 131. The condition determining means 131 determines operation mode of the hearing aid 100 depending upon the condition of the wearer according to predetermined algorithm, and controls the operation mode control portion 103.

Figure 3:
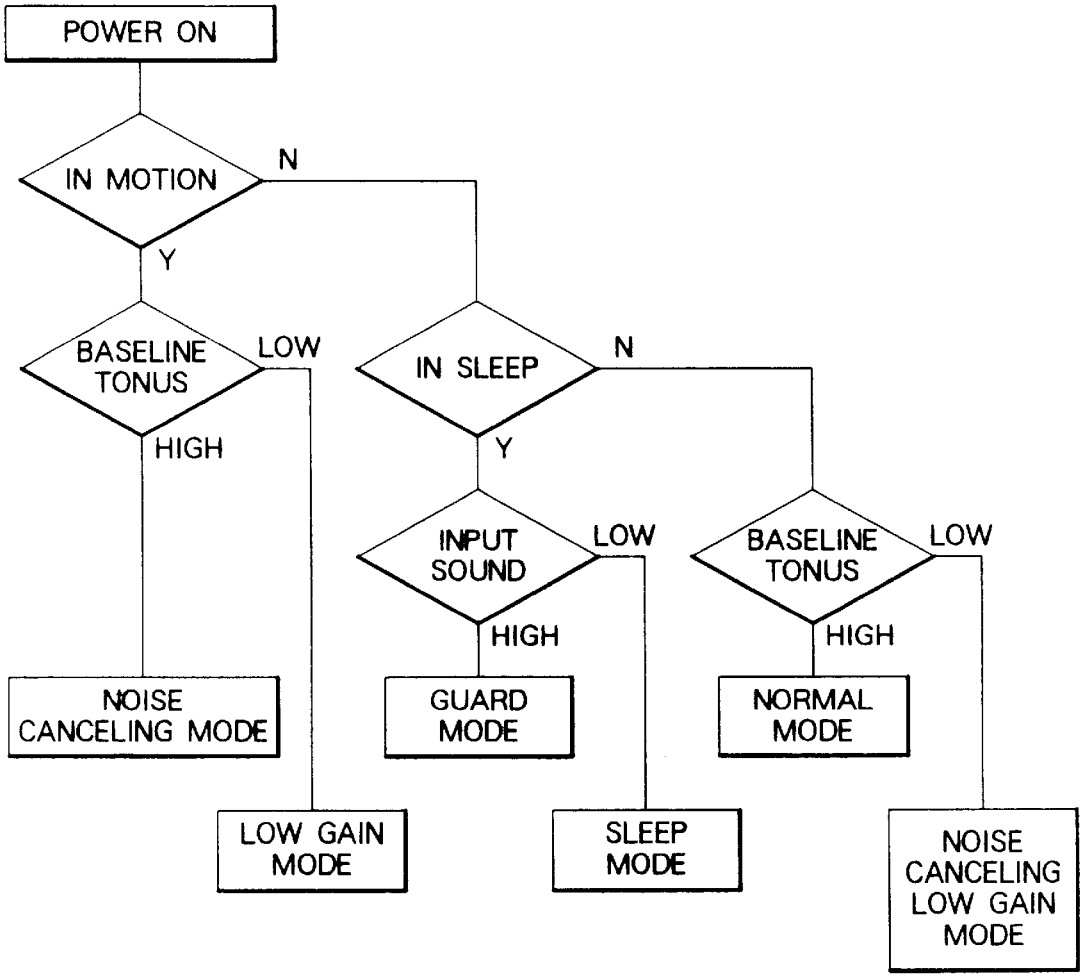
FIG. 3 shows an example of algorithm in the first embodiment of the hearing aid of the invention.

Next, discussion will be given with respect to the foregoing algorithm with reference to FIG. 3. At first, while a power supply is turned ON, the condition detecting means 121, 122, 123 and 124 receive outputs of the pulse sensor 111, the brain wave sensor 112, the conductivity sensor 113 and the acceleration sensor 114 for detecting the condition (biological information, motion) of the wearer, and feed information to the condition determining means 131. Then, in the condition determining means 131, judgement is made for the motion of the wearer on the basis of the information from the sensors 111, 112, 113 and 114. When judgement is made that the wearer is in motion, level of baseline tonus is judged. If judgement is made that level of baseline tonus is high, a signal indicative thereof is output to the operation mode control portion 103. The operation mode control portion 103 then sets the operation mode of the hearing aid at a noise canceling mode. In contrast to this, when judgement is made that the level of baseline tonus is low, a signal indicative thereof is fed to the operation mode control portion 103. Then, the operation mode control portion 103 sets the operation mode of the hearing aid 100 at low gain mode.

On the other hand, when judgement is made that the wearer is not in motion, further judgement is made whether the wearer is in sleep or not. If the wearer is in sleep, Further judgement is made for level of the input sound. If the level of input sound is high, a signal indicative thereof is fed to the operation mode control portion 103. The operation control portion 103 then sets the hearing aid 100 at a guarding mode. In contrast to this, when the input sound level is low, a signal indicative thereof is fed to the operation mode control portion 103. Then, the operation mode control portion 103 sets the operation mode of the hearing aid 100 at a sleep mode.

If judgement is made that the wearer is not in sleep when checking whether the wearer is in sleep or not, the level of baseline tonus is judged. If the baseline tonus level is high, a signal indicative thereof is fed to the operation mode control portion 103. Then, the operation mode control portion 103 sets the operation mode of the hearing aid 100 at a normal mode. If the baseline tonus level is low, the signal indicative thereof is fed to the operation mode control portion 103. Then, the operation mode control portion 103 sets the operation mode of the hearing aid 100 at a noise canceling low gain mode.

It should be noted that, in the shown embodiment, the pulse sensor 111, the brain wave sensor 112, the conductivity sensor 113 and the acceleration sensor 114 are employed as sensors for detecting the wearer's condition, combination of the sensors is not specific to the present invention. Any number and any combinations of sensors which may represent wearer's condition may be applicable for realizing the present invention.

Figure 4:
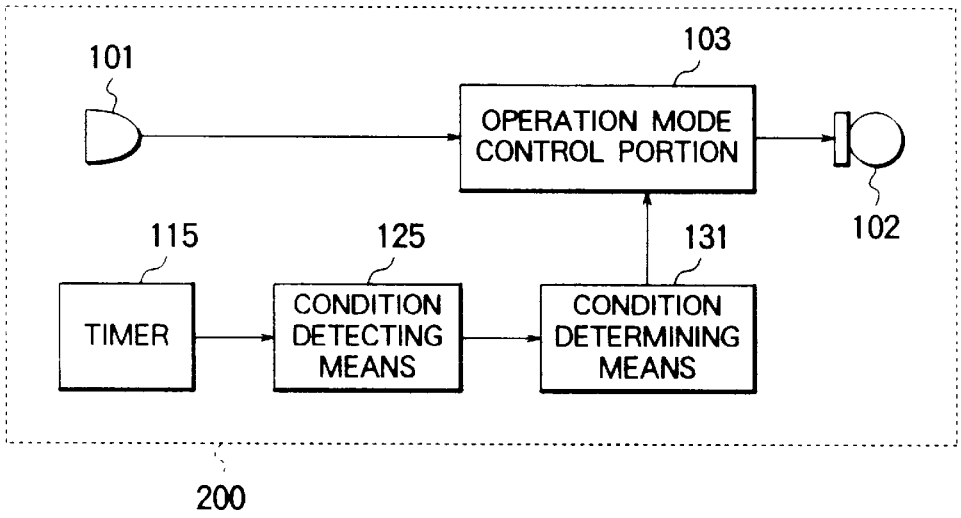
FIG. 4 is a block diagram showing a second embodiment of a hearing aid according to the present invention.

FIG. 4 shows the second embodiment of the hearing aid according to the present invention. The second embodiment of the hearing aid 200 includes the microphone 101 for converting the voice signal into the electric signal, the earphone 102 for converting the output signal into the voice signal, the operation mode control portion 103, a timer 115, a condition detecting means 125 and the condition determining means 131.

In the second embodiment, an output of the timer 115 is input to the condition detecting means 125. Then, a current timing is derived by the condition detecting means 125. The information thus derived by the condition detecting means 125 is input to the condition determining means 131. The condition determining means 131 determines an operation mode of the hearing aid 200 from the timing, according to a predetermined algorithm for controlling the operation mode control portion 103.

Figure 5:
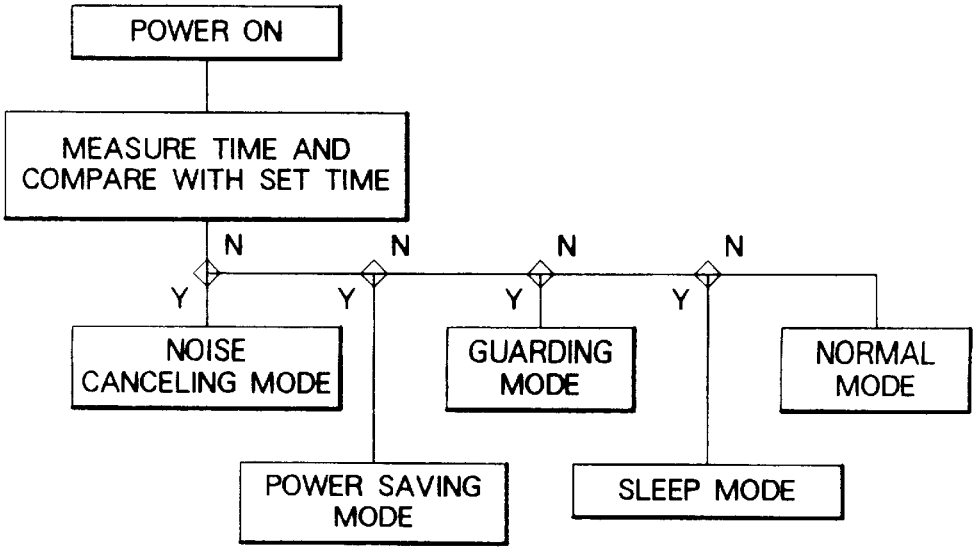
FIG. 5 shows an example of algorithm in the second embodiment of the hearing aid of the invention.

Discussion will be given for algorithm as set forth above with reference to FIG. 5. At first, in the condition where the power supply is ON, time is measured and the measured time is compared with set times. Namely, the condition detecting means 125 derives a current time for inputting the information indicative thereof to the condition determining means 131. Then, the condition determining means 131 performs comparison of various set times with the detected time. The operation mode is selected among the noise canceling mode, the power saving mode, the guarding mode, the sleep mode depending upon the set times in a manner illustrated in FIG. 5. As can be clear from FIG. 5, when the measured time does not match with any of the set times as result of comparison, the normal mode is selected.

As set forth, in the shown embodiment, since the operation modes are varied according to elapsing of time, operation of the hearing aid adapts to of activities of the wearer at respective time in a day. Namely, the operation modes of the hearing aid can be selected adapt to activity pattern of the wearer in a day.

Figure 6:
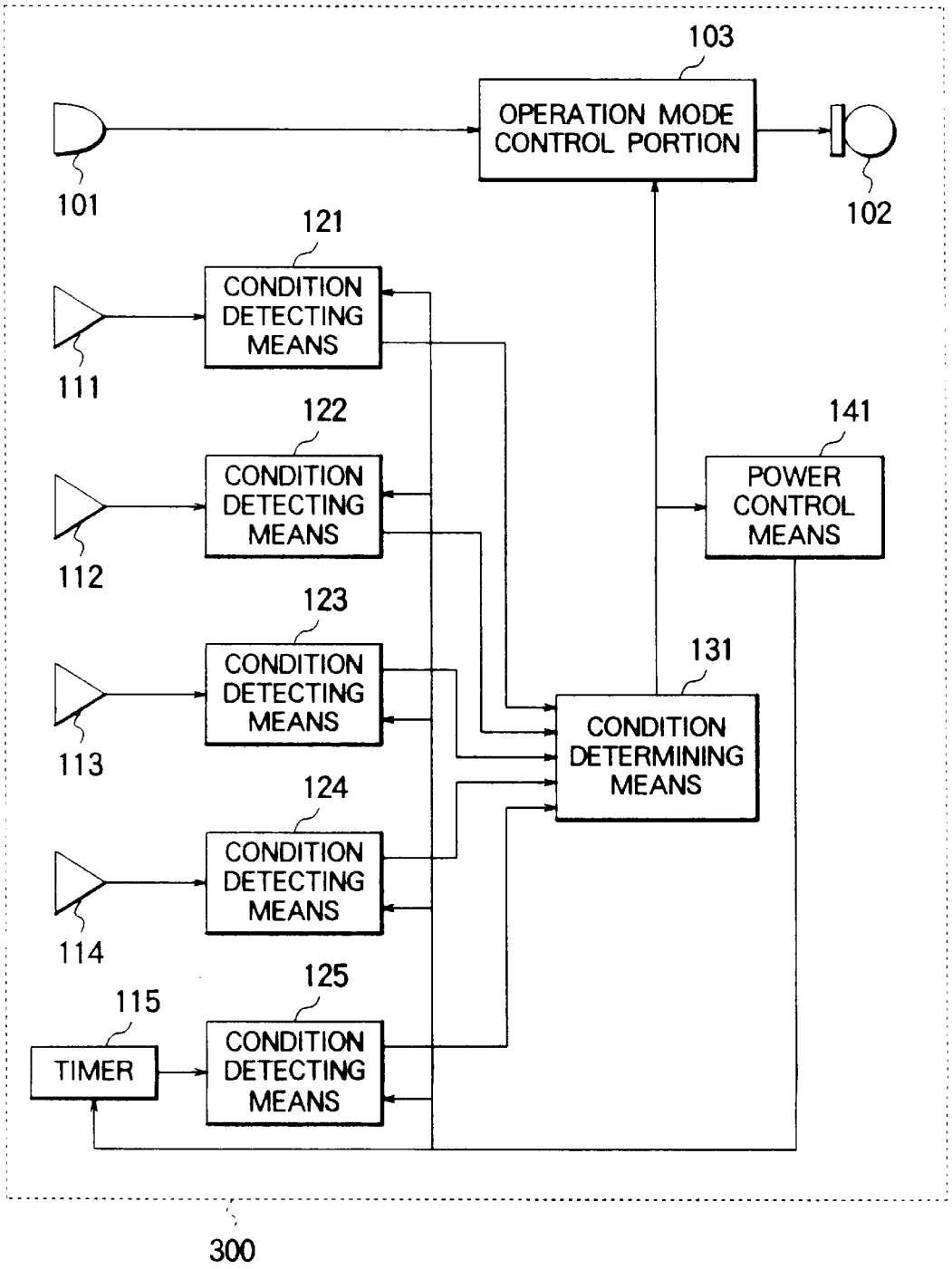
FIG. 6 is a block diagram showing a third embodiment of a hearing aid according to the present invention.

Next, discussion will be given for the third embodiment of the hearing aid according to the present invention with reference to FIG. 6. In the third embodiment of the hearing aid 300, in addition to the first and second embodiments as set forth above, a power control means 141 is provided. The condition determining means 131 controls the power control means 141 in addition to other components in order to vary one or more of the circuit blocks to be operated, voltage, clock frequency and so forth.

Figure 7:
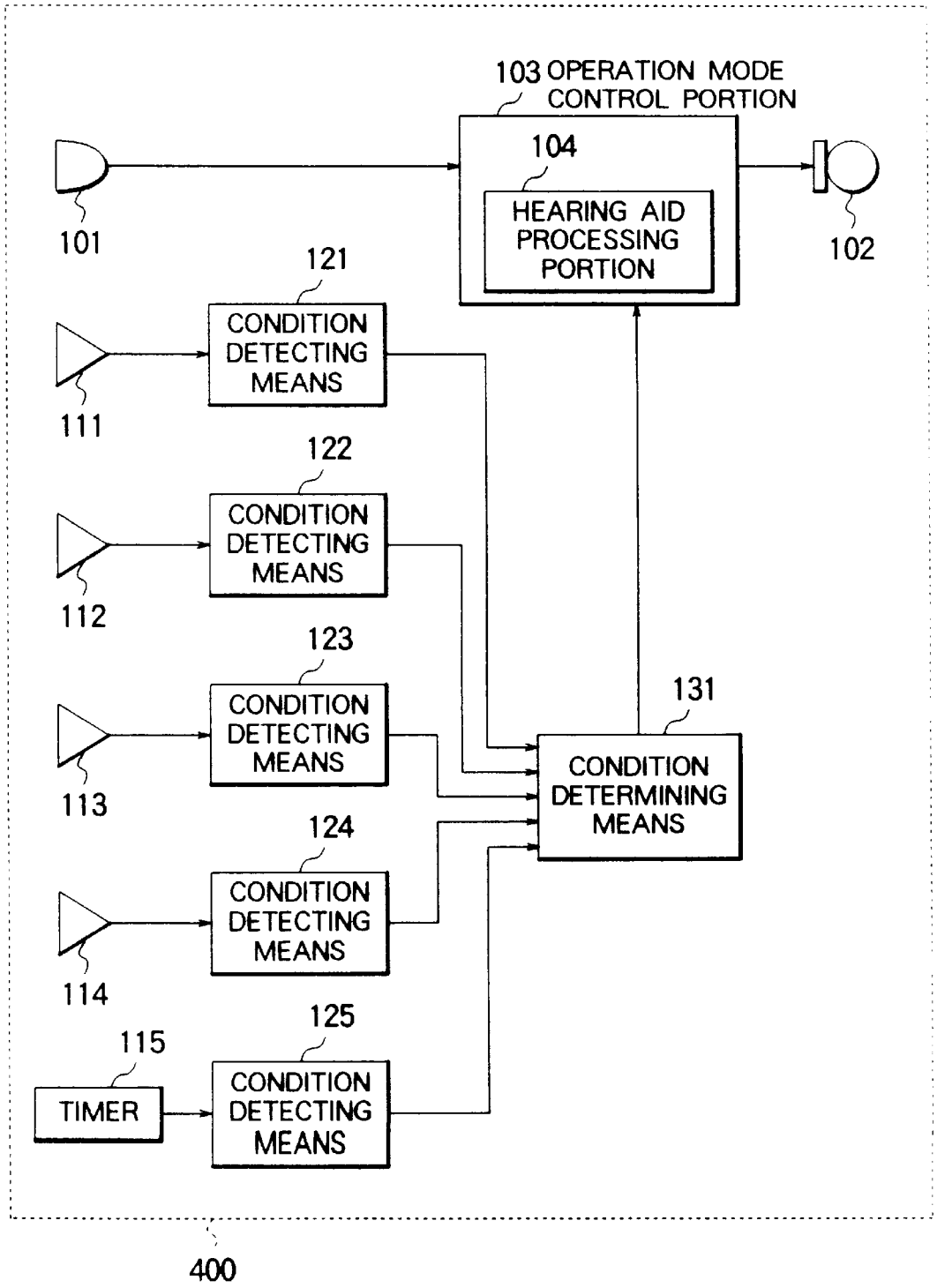
FIG. 7 is a block diagram showing a fourth embodiment of a hearing aid according to the present invention.

FIG. 7 shows the fourth embodiment of the hearing aid 400 according to the present invention. The fourth embodiment of the hearing aid 400 is provided with a hearing aid processing portion 104 in the operation mode control portion 103 in addition to the components in the first and second embodiments as set forth above. In order to vary operation of the hearing aid processing portion 104 and hearing aid processing parameter, which determine the hearing aid characteristics of the hearing aid 400, the condition determining means 131 controls the hearing aid processing portion 104 in the operation mode control portion 103, in addition to other components.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A hearing aid comprising:

at least one condition detecting unit for detecting at least one of a biological signal representative of a condition of a wearer and motion representative of a condition of the wearer other than sound;

a condition determining unit for determining an operation mode on the basis of a result of detection by said condition detecting unit; and an operation mode control portion driving an earphone according to the operation mode output from said condition determining unit.

2. A hearing aid as set forth in claim 1, which further comprises a power control unit for controlling at least one selected from a group consisting of a circuit block to be operated, voltage, and clock frequency depending upon the condition of the wearer and time to control power consumption.

3. A hearing aid as set forth in claim 1, which further comprises a hearing aid processing portion, the operation of said hearing aid processing portion and a hearing aid processing parameter which determines hearing aid characteristics of said hearing aid being varied depending upon said condition of the wearer and time.

4. A hearing aid as set forth in claim 1, wherein the biological signal corresponds to a brain wave activity of the wearer.

5. A hearing aid as set forth in claim 1, wherein the biological signal corresponds to a pulse rate of the wearer.

6. A hearing aid as set forth in claim 1, wherein the operation mode is set to one of a normal mode, a sleep mode, a guarding mode and a noise canceling mode.

7. A hearing aid comprising:

a timing unit for outputting a time, said time corresponding to a current time of day;

a condition determining unit for determining an operation mode responsive to a predicted condition of a wearer, the predicted condition determined on the basis of said time, at least a first and a second different operation mode each being other than modes which produce an off state of said hearing aid; and an operation mode control portion for driving an ear phone of said hearing aid according to the at least first and second operation modes determined from said condition determining unit.

8. A hearing aid as set forth in claim 7, which further comprises a power control unit for controlling at least one selected from a group consisting of a circuit block to be operated, voltage, and clock frequency depending upon the wearer's condition and time to control power consumption.

9. A hearing aid as set forth in claim 7 which further comprises a hearing aid processing portion, the operation of said hearing aid processing portion and a hearing aid processing parameter which determines hearing aid characteristics of said hearing aid being varied depending upon said condition of the wearer and said time.

10. A hearing aid as set forth in claim 7, wherein the operation mode is set to one of a normal mode, a sleep mode, a guarding mode and a noise canceling mode.

11. A hearing aid as set forth in claim 7, wherein the operation mode of said hearing aid is set to one of a plurality of operation modes based on said time, so as to set said operation mode to a particular operation mode at a particular time during each day.

12. A hearing aid as set forth in claim 7, wherein the predicting condition of the wearer is one of awake and asleep.

13. A hearing aid comprising:

at least one condition detecting unit for detecting at least one of a biological signal and motion representative of a condition of a wearer other than sound;

a condition determining unit for determining an operation mode on the basis of a result of detection by said condition detecting means; and an operation mode control portion driving an earphone according to the operation mode output from said condition determining unit, wherein, when said condition determining unit determines that the wearer is not sleeping based on the detected biological signal and that the wearer is in motion, a baseline tonus is determined, and based on the determined baseline tonus, the operation mode is set to one of a noise canceling mode and a low gain mode.

14. A hearing aid as set forth in claim 13, wherein, when said condition determining unit determines that the wearer is sleeping based on the detected biological signal and that the wearer is not in motion, the baseline tonus is determined, and based on the determined baseline tonus, the operation mode is set to one of a sleep mode and a guarding mode.

15. A hearing aid as set forth in claim 14, wherein the noise canceling mode and the guarding mode are set as the operation mode when the baseline tonus is determined to be above a preset threshold, and wherein the low gain mode and the sleep mode are set as the operation mode when the baseline tonus is determined to be below the preset threshold.

16. A hearing aid comprising:

a first condition detecting unit configured to detect a first signal representative of a biological condition of a wearer other than sound;

a second condition detecting unit configured to detect a second signal representative of a motion of the wearer;

a condition determining unit coupled to the first and second detecting units and configured to determine an operation mode on the basis of a result of detection by said first and second condition detecting units; and an operation mode control unit coupled to the condition determining unit and configured to drive an earphone of said hearing aid according to the operation mode output from said condition determining unit.

17. A hearing aid as set forth in claim 16, wherein the biological condition corresponds to one of a brain wave activity and a pulse rate of the wearer.

18. A hearing aid as set forth in claim 17, wherein, when the condition determining unit determines that the wearer is not sleeping based on the detected biological condition and that the wearer is in motion, a baseline tonus is determined, and based on the determined baseline tonus, the operation mode is set to one of a noise canceling mode and a low gain mode.

19. A hearing aid as set forth in claim 18, wherein, when the condition determining unit determines that the wearer is sleeping based on the detected biological condition and that the wearer is not in motion, the baseline tonus is determined, and based on the determined baseline tonus, the operation mode is set to one of a sleep mode and a guarding mode.

* * * * *